US005507384A

United States Patent [19]

Maeng

[11] Patent Number: 5,507,384

[45] Date of Patent: Apr. 16, 1996

[54] GOLF BAG STAND TENSIONER

[76] Inventor: Seop Maeng, 709-4 Gorimri, Yongin-Eup, Yongin-Gun, Kyongi-Do, Rep. of Korea

[21] Appl. No.: 369,773

[22] Filed: Jan. 6, 1995

[30] Foreign Application Priority Data

Jan. 8, 1994 [KR] Rep. of Korea ..... 195/1994

[51] Int. Cl.[6] ..... A63B 55/10

[52] U.S. Cl. ..... 206/315.7; 248/96

[58] Field of Search ..... 206/315.7; 248/96, 248/688

[56] References Cited

U.S. PATENT DOCUMENTS

| | | | |
|---|---|---|---|
| 2,324,439 | 7/1943 | Thommen | 248/96 |
| 2,663,528 | 12/1953 | Hadley | 248/96 |
| 5,147,089 | 9/1992 | Anderson | 206/315.7 X |
| 5,236,085 | 8/1993 | Quellais | 206/315.7 |
| 5,339,951 | 8/1994 | Chen | 206/315.7 |
| 5,351,921 | 10/1994 | Chen | 206/315.7 X |
| 5,407,155 | 4/1995 | Chung | 206/315.7 X |

FOREIGN PATENT DOCUMENTS

| | | | |
|---|---|---|---|
| 29384 | of 1916 | United Kingdom | 248/96 |
| 2278290 | 11/1974 | United Kingdom | 248/96 |

*Primary Examiner*—Allan N. Shoap
*Assistant Examiner*—Christopher J. McDonald
*Attorney, Agent, or Firm*—John J. Connors; Connors & Associates

[57] ABSTRACT

A golf bag stand tensioner suitable for permanently used and readily controlling the tensile force of the golf bag stand is disclosed. The golf bag stand tensioner is movably fitted over a folding grip of the golf bag stand so that the tensioner selectively goes up and down the folding grip in order for controlling tensile force of the folding grip as well as tensile force of the golf bag stand.

2 Claims, 2 Drawing Sheets

GOLF BAG STAND TENSIONER

BACKGROUND OF THE INVENTION

1. Field of the Invention

The present invention relates in general to a golf bag stand tensioner and, more particularly, to a structural improvement in such a golf bag stand tensioner for permanently used and readily controlling the tensile force of the golf bag stand. Such a golf bag stand tensioner is illustrated in U.S. Pat. No. 5,152,483.

2. Description of the Prior Art

With reference to FIG. 3, there is shown a golf bag stand provided with a typical golf bag stand tensioner. As shown in this drawing, opposed top arms of the golf bag stand 1 are pivoted to opposed sides of a bracket 2 of a golf bag (not shown). The pivoted state of the stand 1 relative to the bracket 2 is kept by an elastic band 4, which band 4 is tightly hooked on a pair of hooks 3 provided on the tope section of the stand 1.

However, repeated folding and spreading motions of the stand 1 is accompanied by repeated tensioning and shrinkage of the elastic band 4 and this inevitably reduces the elasticity of the elastic band 1 with the lapse of the time so that the restoring force of the elastic band 4 will be reduced. The elastic band 4 with reduced elasticity will fail in achievement of elastic folding and spreading motions of the stand 1 and cause shake of the stand 1 when the golf bag with the folded stand is carried with the golfer. The elastic band 4 thus needs to be often changed with new one.

SUMMARY OF THE INVENTION

It is, therefore, an object of the present invention to provide a golf bag stand tensioner in which the above problem can be overcome and which is fitted over the lower section of a folding grip of the stand and not only permanently tensions the stand but also controls the tensile force of the stand, thus to remove the necessity of often change of the golf bag stand tensioner differently from the typical elastic band.

In order to accomplish the above object, an embodiment of the invention provides in a golf bag stand having a folding grip for folding and spreading the golf bag stand, and a tensioner for tensioning the stand, wherein the tensioner is movably fitted over the folding grip so that the tensioner selectively goes up and down the folding grip in order for controlling tensile force of the folding grip as well as tensile force of the golf bag stand.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 3:
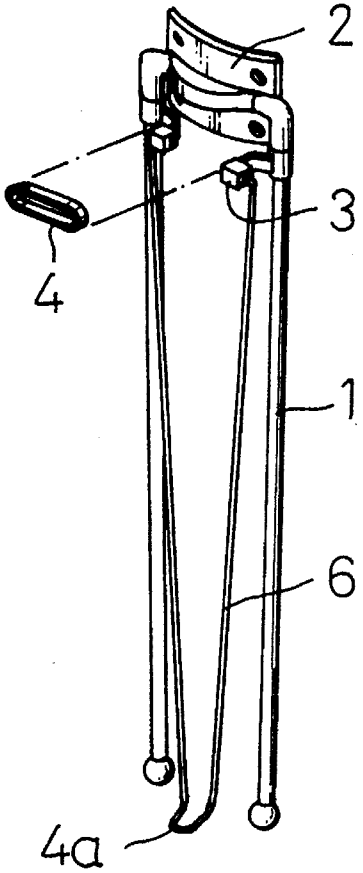
FIG. 3 is an exploded perspective view of a golf bag stand provided with an elastic band as a typical golf bag stand tensioner.
Figure 2:
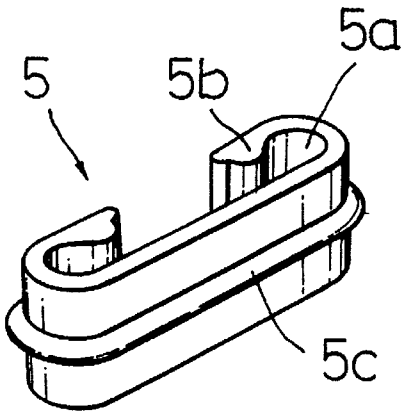
FIG. 2 is a perspective view of the golf bag stand tensioner of FIG. 1.
Figure 1:
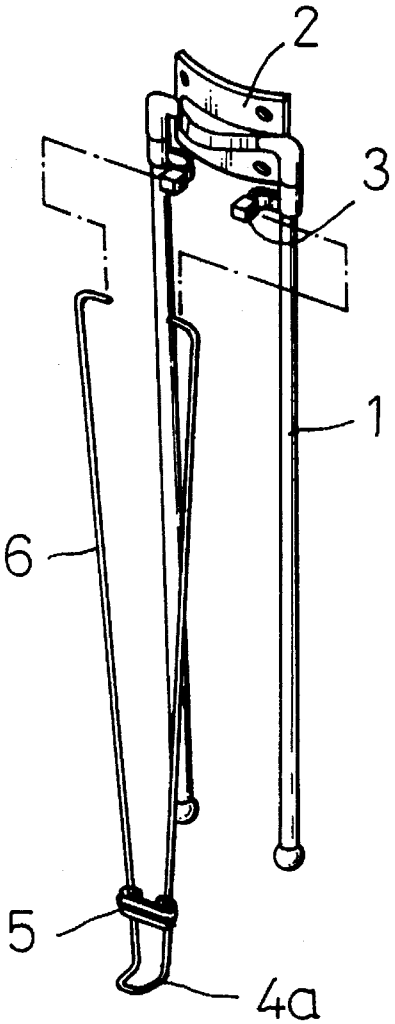
FIG. 1 is an exploded perspective view of a golf bag stand with a golf bag stand tensioner in accordance with an embodiment of the present invention.

FIG. 1 is an exploded perspective view of a golf bag stand with a golf bad stand tensioner in accordance with an embodiment of the present invention, FIG. 2 is a perspective view of the golf bag stand tensioner of FIG. 1.

As shown in FIG. 1, the golf bag stand tensioner 5 of the invention is movably fitted over a folding grip 6 of the golf bag stand 1 such that the tensioner 5 selectively goes up and down the folding grip 6. The folding grip 6 has a substantially V-shaped configuration and fixed at its opposed top ends to the hooks 3 provided in the top section of the stand 1. The golf bag stand 1 is tensioned by tightly grasping the folding grip 6. As shown in FIG. 2, the golf bag stand tensioner 5 of the invention is a single body whose opposed sides are smoothly rounded so as to form arm fitting lips 5*a*, which lips 5*a* are fitted over their associated arms of the folding grip 6. The lips 5*a* are provided with tangs 5*b* for prevention of sudden separation of the tensioner 5 from the arms of the folding grip 6. The tensioner 5 is also provided with a longitudinal reinforcing band 5*c*, which band 56*c* is longitudinally provided on the outer surface of the tensioner 5.

As described above, the golf bag stand tensioner 5 of the invention is movably fitted over the lower section of the folding grip 6 of the stand 1 such that the tensioner 5 elastically grasps the folding grip 6. Therefore, the folding grip 6 is tensioned by the tensioner 5 and this makes the golf bag stand 1 be naturally tensioned. When it is required to more tension the golf bag stand 1, the tensioner 5 goes up the folding grip 6 so that the gap between the arms of the substantially V-shaped folding grip 6 becomes narrow. Therefore, the folding grip 6 is more tensioned and this makes the golf bag stand 1 be more tensioned. On the contrary, when it is required to loose the golf bag stand 1, the tensioner 5 goes down the folding grip 6 so that the gap between the arms of the substantially V-shaped folding grip 6 becomes wide and more looses. This makes the golf bag stand 1 more looses. Therefore, the golf bag stand tensioner 5 of the invention readily controls the tensile force of the golf bag stand 1.

As described above, a golf bag stand tensioner of the present invention is fitted over a folding grip of the golf bag stand and can be permanently used so that the tensioner removes the necessity of often change of the tensioner differently from the typical tensioner or the elastic band. The golf bag stand tensioner also secures smooth, resilient folding and spreading motions of the golf bag stand and, furthermore, controls the tensile force of the golf bag stand as demanded.

Figure 3A:
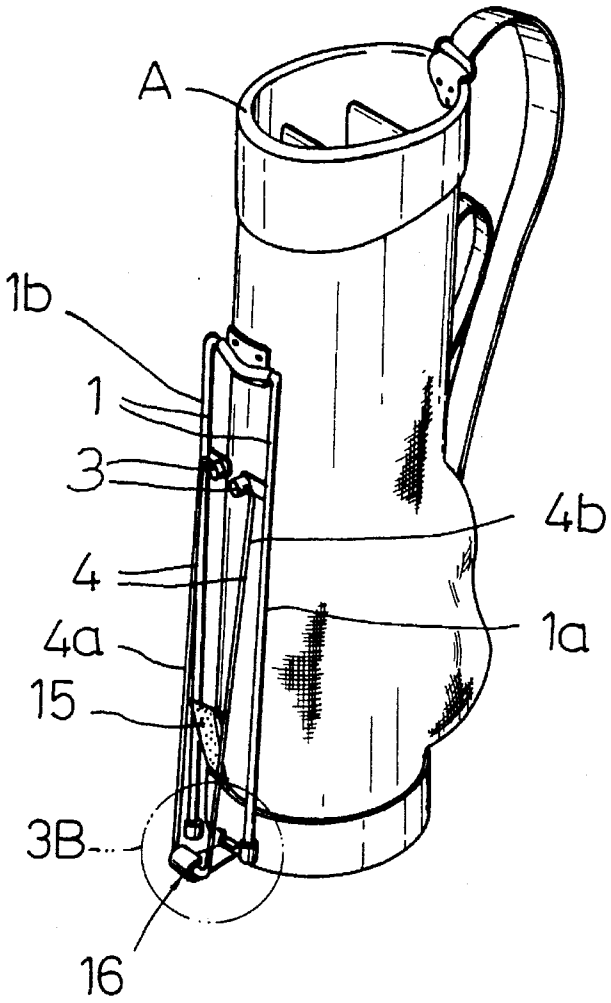
FIG. 3A is a perspective view of a golf bag using a typical prior art stand as illustrated in U.S. Pat. No. 5,152,483.
Figure 3B:
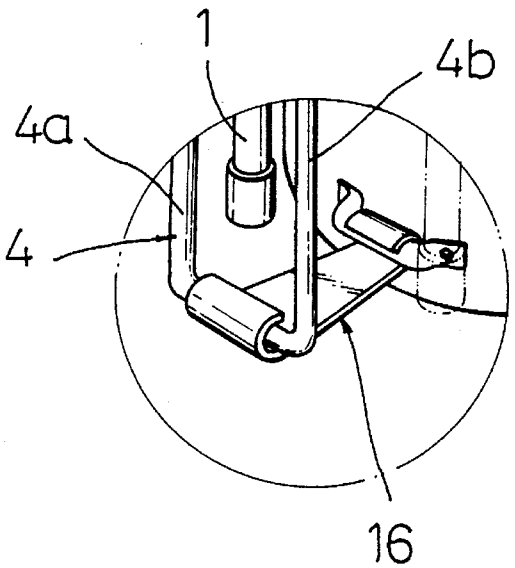
FIG. 3B is an enlarged view of the portion of FIG. 3A encircled by line 3B.

As depicted in FIGS. 3A and 3B, the folding grip 6 serves as an actuating member, and has its lower end 4*a* at the bite of the V pivotally connected to a pivoting drive member 16 attached to the bottom of a bag body A, and each of its hooks 3 on the ends of its arms 6*a* and 6*b* connected to the stand 1. The legs 1*a* and 1*b* of the stand 1 are moved between an extended position and a retracted position according to the movement of the bag body A between a titled position and an upright position. The upper ends of the legs 1*a* and 1*b* of the stand are each pivotally connected to the bracket 2 which serves as a pivot member. The elastic band 4 provides the force to return the stand 1 to its retracted position upon lifting the bag body A off the ground or tilting it to an upright position.

As explained in detail in U.S. Pat. No. 5,152,483, by pressing the drive member 16 downward against the ground, the drive member, interacting with the folding grip 6, causes the stand 1 to move between the retracted position with the legs 1*a* and 1*b* of the stand 1 adjacent the bag body A to an extended position where the legs of the stand 1 extended outward from the bag body. This enables the bag body A to be maintained in an upright condition supported only by the stand 1.

In U.S. Pat. No. 5,152,483, a resilient member 15 is provided connecting the holding grip 6 to the bag body A. This resilient member 15 may be replaced by the elastic band 4 wrapped around the hooks 3, but this band 4 is still deficient as discussed above.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A golf bag comprising a bag body having a lower portion and an upper portion, a pivot member attached to the upper portion of the bag body, a pair of legs, each having an upper end pivotally attached to said pivot member, an actuating member having an upper portion and a lower portion, said actuating member being connected to the legs to move said legs between an extended position and a retracted position according to the movement of the bag body between a tilted position and an upright position, said actuating member having a pair of arms joined at ends thereof so that the actuating member has a generally V-shaped configuration, and a tension member mounted on the actuating member for controlling a resilient force that urges the legs into the retracted position, said tension member having opposed ends, each end gripping one arm and being manually moveable relative to the bag body to slide along said arms to change the spacing between the arms and vary the resilient force.

2. The golf bag of claim 1 where the tension member has a generally C-shaped configuration.

* * * * *